US011846148B2

(12) United States Patent
Al Dossary

(10) Patent No.: US 11,846,148 B2
(45) Date of Patent: Dec. 19, 2023

(54) BALLOON-EQUIPPED AUTONOMOUS DOWNHOLE LOGGING TOOL FOR OIL AND GAS WELLS

(71) Applicant: Saudi Arabian Oil Company, Dhahran (SA)

(72) Inventor: Faisal Al Dossary, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 44 days.

(21) Appl. No.: 17/488,936

(22) Filed: Sep. 29, 2021

(65) Prior Publication Data

US 2023/0100331 A1 Mar. 30, 2023

(51) Int. Cl.

| | |
|---|---|
| ***E21B 23/04*** | (2006.01) |
| ***E21B 23/00*** | (2006.01) |
| ***E21B 23/14*** | (2006.01) |
| ***E21B 47/12*** | (2012.01) |

(52) U.S. Cl.

CPC ..... *E21B 23/001* (2020.05); *E21B 23/0415* (2020.05); *E21B 23/14* (2013.01); *E21B 47/12* (2013.01)

(58) Field of Classification Search

CPC .... E21B 23/001; E21B 23/14; E21B 23/0415; E21B 47/12; E21B 47/138

See application file for complete search history.

(56) References Cited

U.S. PATENT DOCUMENTS

| | | | | |
|---|---|---|---|---|
| 3,509,772 | A * | 5/1970 | Blair | E21B 49/025 73/864.42 |
| 4,706,746 | A | 11/1987 | White et al. | |
| 7,232,354 | B2 * | 6/2007 | Olson | B63B 22/12 441/7 |
| 2005/0241835 | A1 * | 11/2005 | Burris, II | E21B 23/10 166/313 |

(Continued)

FOREIGN PATENT DOCUMENTS

| | | |
|---|---|---|
| WO | WO 2007078214 | 7/2007 |

OTHER PUBLICATIONS

Buzi et al., "Sensor Ball: An Autonomous Untethered Logging Platform," Offshore Technology Conference, Houston, TX, May 2020, 10 pages.

(Continued)

*Primary Examiner* — D. Andrews
(74) *Attorney, Agent, or Firm* — Fish & Richardson P.C.

(57) ABSTRACT

Systems and methods include a method for using a downhole logging tool. A downhole logging tool is inserted into a well. The downhole logging tool includes a gauge chamber containing gauges, a compressed gas chamber containing compressed gas, a timer powered by a battery, a release sub, and a balloon housing containing a balloon in a deflated state. Data is collected by the gauges of the downhole logging tool during a downward travel of the downhole logging tool. A release point to release compressed gas is determined by the timer based on a travelling speed of the downhole logging tool. The compressed gas is released by (Continued)

the release sub at the release point, inflating the balloon to an inflated state, creating a buoyant force for the downhole logging tool. Additional data is collected by the gauges of the downhole logging tool during an upward travel of the downhole logging tool.

20 Claims, 3 Drawing Sheets

(56) References Cited

U.S. PATENT DOCUMENTS

| | | | | |
|---|---|---|---|---|
| 2016/0320769 | A1* | 11/2016 | Deffenbaugh | E21B 47/06 |
| 2020/0131899 | A1* | 4/2020 | Chen | E21B 47/10 |
| 2020/0392803 | A1* | 12/2020 | Zhao | E21B 47/00 |

OTHER PUBLICATIONS

Gardner et al., "Micro-Sonde Well Logging System," SPE Bergen One Day Seminar, Bergen, Norway, Society of Petroleum Engineers, Apr. 2017, 13 pages.

* cited by examiner

BALLOON-EQUIPPED AUTONOMOUS DOWNHOLE LOGGING TOOL FOR OIL AND GAS WELLS

TECHNICAL FIELD

The present disclosure applies to determining conditions in wells, such as gas and oil wells.

BACKGROUND

Downhole conditions of oil and gas reservoirs change with time. Monitoring changes over time is critical to enhancing hydrocarbon recovery from the reservoirs. In typical conventional systems, measurements of physical and chemical properties of downhole formation fluids can be captured using wireline logging or permanent downhole sensors.

Thousands of surveys are performed every year in oil fields throughout the world. Much of the work is done offshore, which can require significant logistical preparations related to offshore barges, wireline equipment, and well-trained manpower.

SUMMARY

The present disclosure describes techniques for using a balloon-equipped autonomous downhole logging tool for oil and gas wells. In some implementations, a computer-implemented method includes the following. A downhole logging tool is inserted into a well. The downhole logging tool includes a gauge chamber containing gauges, a compressed gas chamber containing compressed gas, a timer powered by a battery, a release sub, and a balloon housing containing a balloon in a deflated state. Data is collected by the gauges of the downhole logging tool during a downward travel of the downhole logging tool. A release point to release compressed gas is determined by the timer based on a travelling speed of the downhole logging tool. The compressed gas is released by the release sub at the release point, inflating the balloon to an inflated state, and creating a buoyant force for the downhole logging tool. Additional data is collected by the gauges of the downhole logging tool during an upward travel of the downhole logging tool.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Autonomously logging operations can be conducted in new drilling frontiers using a surveillance tool without the need for expensive logistics and equipment. Risks for using the techniques of the present disclosure are low. The introduction of a gas, such as helium, effectively reduces the weight of the surveillance tool, allowing the surveillance tool to float across the oil and gas column in the oil wells. Conventional pressure/temperature surveys are typically limited to water mediums because of buoyancy forces that limit the survey equipment to water wells. As a result, adding a gas component can facilitate extending the use of pressure/temperature surveys to oil wells. The use of helium, for example, can allow the surveillance tool to perform the surveys in oil and gas wells by running in hole with the weight while recording pressure/temperature readings. At a certain time, the surveillance tool can drop the weight while inflating the gas component to a specific dimension to make the surveillance tool perform like a hot air balloon, reducing its density and allowing the surveillance tool to float to the surface. Significant cost reductions can be made in operations, such as in logistical preparations related to offshore barges, wireline equipment, and well-trained manpower.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

Figure 1:
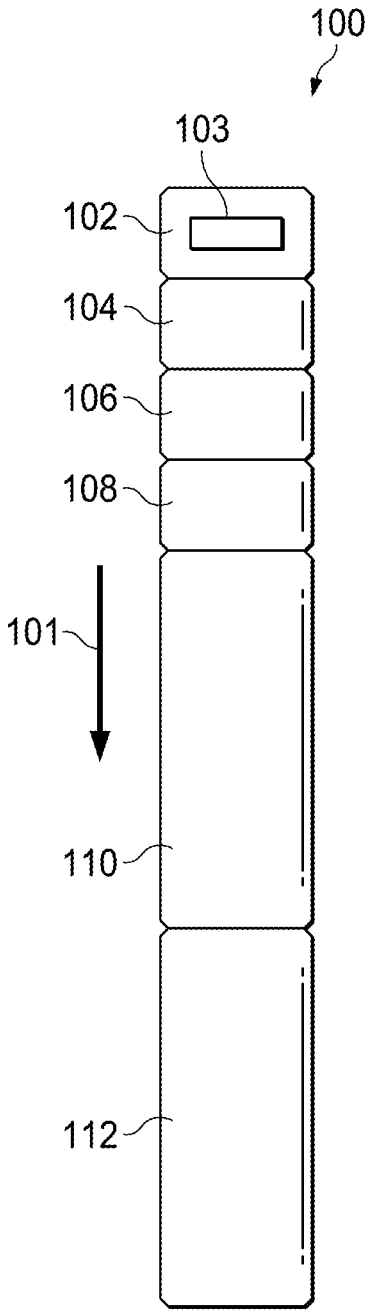
FIG. 1 is a block diagram of a balloon-equipped autonomous downhole logging tool with a balloon in a deflated state corresponding to a downward traveling direction, according to some implementations of the present disclosure.

The following detailed description describes techniques for using a balloon-equipped autonomous downhole logging tool for oil and gas wells. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

Using a balloon-equipped autonomous downhole logging tool for oil and gas wells can provide advantages over conventional systems using techniques such as wireline logging or permanent downhole sensors. A conventional system may include a surveillance tool serving as an autonomous platform which is driven, at least in part, by natural forces. For example, gravity can drag the tool down into an oil well. At a pre-determined time, a small dissolvable metal weight can be released at a pre-programmed depth to change the tool's buoyancy from negative to positive, allowing the tool to float back to the surface. During operation, the tool can record data as it travels downward and upward in the well. Data recorded by the tool can be wirelessly downloaded when the tool returns to the surface.

However, conventional tools relying on gravity alone have been determined to be reliable only in water wells. In this example, the main challenge with a conventional tool is the tool's inability to travel up a gas column, such as at the more upward depths of an oil well. The reason is that the tool will only float by buoyancy in the liquid phase. This makes conventional tool impractical for use in almost all oil wells.

Techniques of the present disclosure include an improved design that enables a tool, such as a balloon-equipped autonomous downhole logging tool, to float in oil wells and then to the surface, even in a gas phase. The improved design incorporates a gas component configured to reduce the surveillance tool device's density, enabling flotation to the surface in both oil and gas phases. The gas used in the gas component can be helium, for example. In the improved design, a gas chamber can be built into the tool. The gas chamber can be triggered to release helium, for example, at a pre-determined depth to inflate a balloon which will carry the balloon-equipped autonomous downhole logging tool to the surface. This can enable the completion of downhole logging jobs without the need, for example, of a wireline unit.

Including a gas component in the downhole logging tool can provide a "diving balloon sensor" of sorts that will make the device float in an oil-and-gas column to the cap of a wellhead. This is an improvement over conventional sensor ball devices, for example, that experience a drawback of not floating to the surface in the case of oil and gas wells. The inclusion of the gas component can provide flotation in different phases and can further resolve the challenge of retrieving the tools after finishing data recording. The balloon-equipped autonomous downhole logging tool is capable of running in hole while recording the pressure and temperature in addition to capturing magnetic readings in water phases.

FIG. 1 is a block diagram of a balloon-equipped autonomous downhole logging tool 100 with a balloon in a deflated state corresponding to a downward traveling direction 101, according to some implementations of the present disclosure. The balloon-equipped autonomous downhole logging tool 100 (or simply, downhole logging tool 100 or surveillance tool) can be used for logging downhole data in a gas or oil well, for example.

Figure 2:
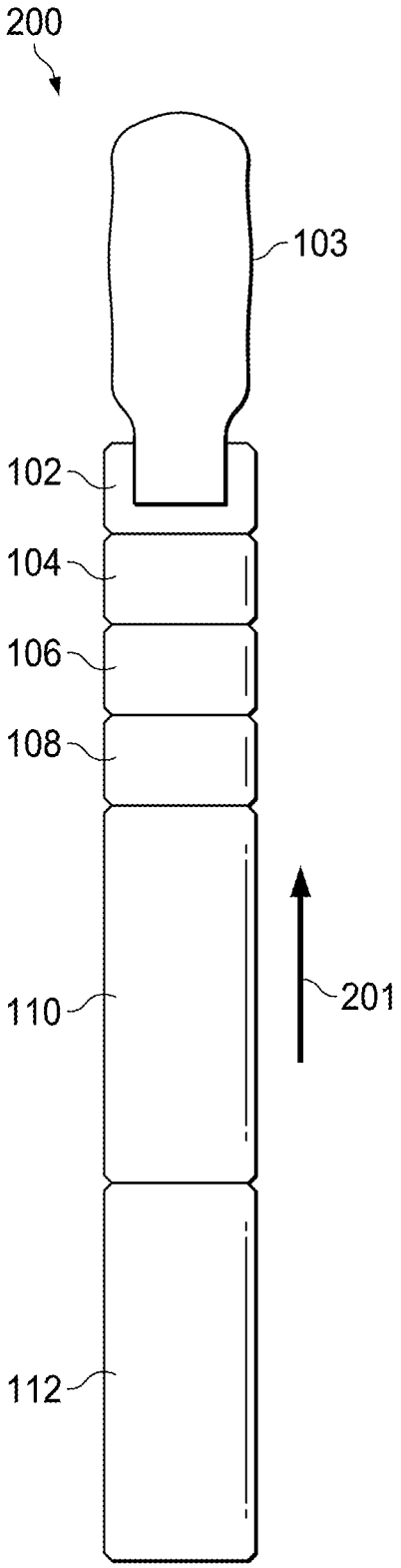
FIG. 2 is a block diagram of the balloon-equipped autonomous downhole logging tool with a balloon in an inflated state corresponding to an upward traveling direction, according to some implementations of the present disclosure.

A balloon housing 102 in the downhole logging tool 100 can house a balloon 103. The balloon 103 can initially be in a deflated state, such as when the downhole logging tool 100 is dropped into a well to begin logging. At a release point (such as a pre-determined time or depth), a release sub-assembly (or "sub") 104 can release compressed gas (for example, helium) into the balloon 103. A timer 106 powered by a battery 108, for example, can be used in determining the release point that is relative to time and/or depth in the well. The compressed gas can be released from a gas chamber 110 (for example, a helium chamber) at a rate and a duration controlled by the sub 104. Releasing the compressed gas can inflate the balloon 103 to an inflated state (as shown in FIG. 2), where the compressed gas creates a buoyant force for the downhole logging tool 100. Releasing the compressed gas can slow the descent of the downhole logging tool 100, ultimately to a point in the well where the downhole logging tool 100 reverses direction and moves upward in the well. Rates of fluid movement and balloon inflation rates can be adjusted and controlled from the surface.

The downhole logging tool 100 includes a gauge carrier 112 containing gauges for taking measurements or readings, such as related to pressure, temperature, and speed (for example, traveling speed of the downhole logging tool 100). Other types of gauges are possible. The gauges of the downhole logging tool 100 make it possible to gather data during a downward travel of the downhole logging tool 100 and then again during an upward travel of the downhole logging tool 100. The downhole logging tool 100 can be sized, for example, with a diameter to fit into a standard four-inch well pipe, but other sizes are possible for all types of wells.

FIG. 2 is a block diagram of the balloon-equipped autonomous downhole logging tool 100 with a balloon in an inflated state corresponding to an upward traveling direction 201, according to some implementations of the present disclosure. In FIG. 2, the balloon 103 is shown in an inflated state, different from the deflated state shown in FIG. 1.

In some implementations, the downhole logging tool 100 can be a commercially-available tool that can be manufactured to mount any sensor or tool. For example, an oil company can buy components of the downhole logging tool 100 including some or all of the components shown in FIG. 1. The company can then mount its own sensors or other equipment on the downhole logging tool 100.

Figure 3:
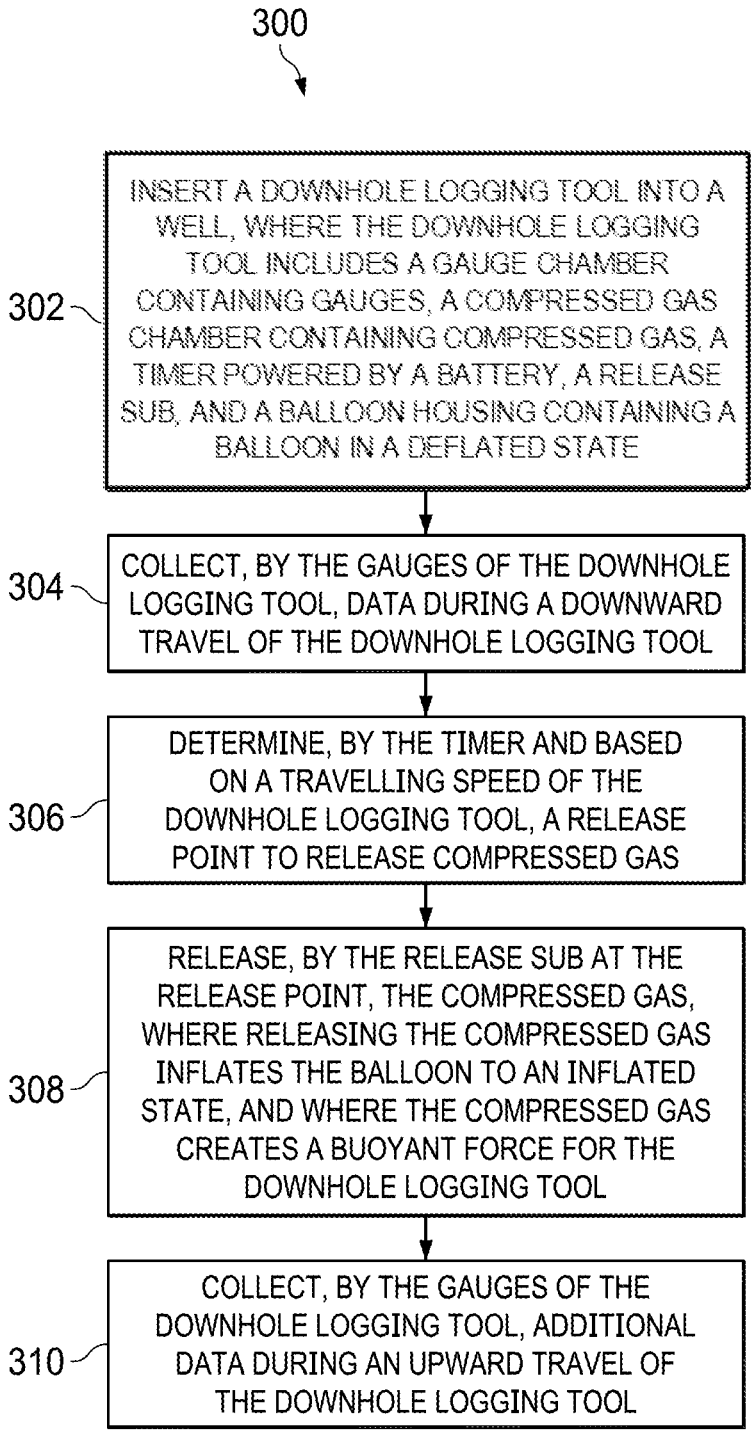
FIG. 3 is a flowchart of an example of a method for using a balloon-equipped autonomous downhole logging tool for oil and gas wells, according to some implementations of the present disclosure.

FIG. 3 is a flowchart of an example of a method 300 for using a balloon-equipped autonomous downhole logging tool for oil and gas wells, according to some implementations of the present disclosure. For clarity of presentation, the description that follows generally describes method 300 in the context of the other figures in this description. However, it will be understood that method 300 can be performed, for example, by any suitable system, environment, software, and hardware, or a combination of systems, environments, software, and hardware, as appropriate. In some implementations, various steps of method 300 can be run in parallel, in combination, in loops, or in any order.

At 302, a downhole logging tool is inserted into a well. For example, the downhole logging tool can be dropped into the hole of an oil or gas well. The downhole logging tool includes a gauge chamber containing gauges, a compressed gas chamber containing compressed gas (for example, helium), a timer powered by a battery, a release sub, and a balloon housing containing a balloon in a deflated state. The release sub can be powered by the battery. When the downhole logging tool is inserted into the well, the downhole logging tool drops due to gravitational forces. From 302, method 300 proceeds to 302.

At 304, data is collected by the gauges of the downhole logging tool during a downward travel of the downhole logging tool. For example, collecting the data and additional data can include recording, by the gauges, readings for pressure, temperature, and speed. From 304, method 300 proceeds to 306.

At 306, a release point to release compressed gas is determined by the timer based on a travelling speed of the downhole logging tool. For example, the release point can be a preprogrammed depth that is triggered based on the timer and travelling speed. In some implementations, the depth can be determined based on the pressure determined by a pressure gauge in the gauge carrier 112. From 306, method 300 proceeds to 308.

At 308, the compressed gas is released by the release sub at the release point. Releasing the compressed gas inflates the balloon to an inflated state. For example, the releasing the compressed can cause the balloon to inflate to a predetermined dimension. The compressed gas creates a buoyant force for the downhole logging tool. Releasing the compressed gas can allow the tool to start an upward travel. There can be other features that are used to help the tool start, control, or accelerate the upward travel. From 308, method 300 proceeds to 310.

At 310, additional data is collected by the gauges of the downhole logging tool during an upward travel of the downhole logging tool 100. The additional information that is gathered can be used in conjunction with the data captured during the downward travel of the downhole logging tool 100. After 310, method 300 can stop.

In some implementations, method 300 further includes pre-programming the downhole logging tool with a time at which to release the compressed gas. For example, at the surface, before deployment of the downhole logging tool 100, data can be loaded onto the downhole logging tool 100 to be used by the release sub. The data can be loaded using, for example, information transmitted by BLUETOOTH or near field communication (NFC) from software applications and systems at the surface. Data can be fed and retrieved from the tool through BLUETOOTH or using hard wires to computer system software.

In some implementations, method 300 further includes pre-programming the downhole logging tool with a depth at which to release the compressed gas. For example, a depth of X feet can be programmed into the downhole logging tool 100.

Figure 4:
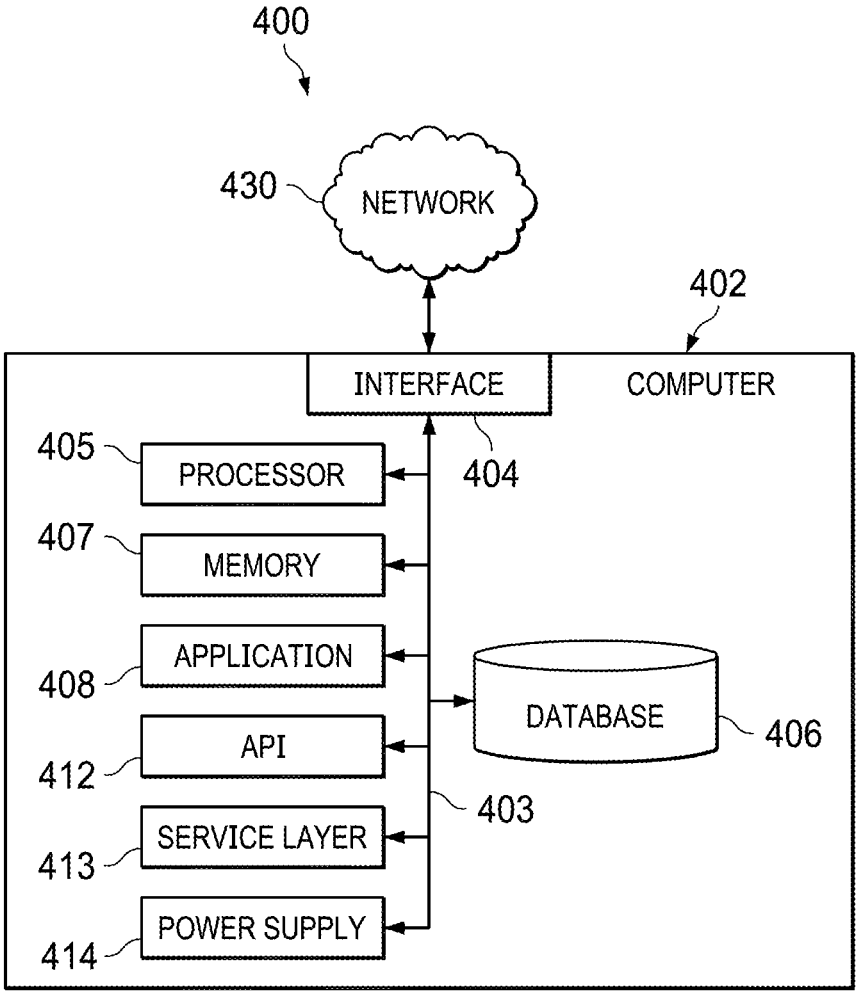
FIG. 4 is a block diagram illustrating an example computer system used to provide computational functionalities associated with described algorithms, methods, functions, processes, flows, and procedures as described in the present disclosure, according to some implementations of the present disclosure.

FIG. 4 is a block diagram of an example computer system 400 used to provide computational functionalities associated with described algorithms, methods, functions, processes, flows, and procedures described in the present disclosure, according to some implementations of the present disclosure. The illustrated computer 402 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 402 can include input devices such as keypads, keyboards, and touch screens that can accept user information. Also, the computer 402 can include output devices that can convey information associated with the operation of the computer 402. The information can include digital data, visual data, audio information, or a combination of information. The information can be presented in a graphical user interface (UI) (or GUI).

The computer 402 can serve in a role as a client, a network component, a server, a database, a persistency, or components of a computer system for performing the subject matter described in the present disclosure. The illustrated computer 402 is communicably coupled with a network 430. In some implementations, one or more components of the computer 402 can be configured to operate within different environments, including cloud-computing-based environments, local environments, global environments, and combinations of environments.

At a top level, the computer 402 is an electronic computing device operable to receive, transmit, process, store, and manage data and information associated with the described subject matter. According to some implementations, the computer 402 can also include, or be communicably coupled with, an application server, an email server, a web server, a caching server, a streaming data server, or a combination of servers.

The computer 402 can receive requests over network 430 from a client application (for example, executing on another computer 402). The computer 402 can respond to the received requests by processing the received requests using software applications. Requests can also be sent to the computer 402 from internal users (for example, from a command console), external (or third) parties, automated applications, entities, individuals, systems, and computers.

Each of the components of the computer 402 can communicate using a system bus 403. In some implementations, any or all of the components of the computer 402, including hardware or software components, can interface with each other or the interface 404 (or a combination of both) over the system bus 403. Interfaces can use an application programming interface (API) 412, a service layer 413, or a combination of the API 412 and service layer 413. The API 412 can include specifications for routines, data structures, and object classes. The API 412 can be either computer-language independent or dependent. The API 412 can refer to a complete interface, a single function, or a set of APIs.

The service layer 413 can provide software services to the computer 402 and other components (whether illustrated or not) that are communicably coupled to the computer 402. The functionality of the computer 402 can be accessible for all service consumers using this service layer. Software services, such as those provided by the service layer 413, can provide reusable, defined functionalities through a defined interface. For example, the interface can be software written in JAVA, C++, or a language providing data in extensible markup language (XML) format. While illustrated as an integrated component of the computer 402, in alternative implementations, the API 412 or the service layer 413 can be stand-alone components in relation to other components of the computer 402 and other components communicably coupled to the computer 402. Moreover, any or all parts of the API 412 or the service layer 413 can be implemented as child or sub-modules of another software module, enterprise application, or hardware module without departing from the scope of the present disclosure.

The computer 402 includes an interface 404. Although illustrated as a single interface 404 in FIG. 4, two or more interfaces 404 can be used according to particular needs, desires, or particular implementations of the computer 402 and the described functionality. The interface 404 can be used by the computer 402 for communicating with other systems that are connected to the network 430 (whether illustrated or not) in a distributed environment. Generally, the interface 404 can include, or be implemented using, logic encoded in software or hardware (or a combination of software and hardware) operable to communicate with the network 430. More specifically, the interface 404 can include software supporting one or more communication protocols associated with communications. As such, the network 430 or the interface's hardware can be operable to communicate physical signals within and outside of the illustrated computer 402.

The computer 402 includes a processor 405. Although illustrated as a single processor 405 in FIG. 4, two or more processors 405 can be used according to particular needs, desires, or particular implementations of the computer 402 and the described functionality. Generally, the processor 405 can execute instructions and can manipulate data to perform the operations of the computer 402, including operations using algorithms, methods, functions, processes, flows, and procedures as described in the present disclosure.

The computer 402 also includes a database 406 that can hold data for the computer 402 and other components connected to the network 430 (whether illustrated or not). For example, database 406 can be an in-memory, conventional, or a database storing data consistent with the present disclosure. In some implementations, database 406 can be a combination of two or more different database types (for example, hybrid in-memory and conventional databases) according to particular needs, desires, or particular implementations of the computer 402 and the described functionality. Although illustrated as a single database 406 in FIG. 4, two or more databases (of the same, different, or combination of types) can be used according to particular needs, desires, or particular implementations of the computer 402 and the described functionality. While database 406 is illustrated as an internal component of the computer 402, in alternative implementations, database 406 can be external to the computer 402.

The computer 402 also includes a memory 407 that can hold data for the computer 402 or a combination of components connected to the network 430 (whether illustrated or not). Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 (of the same, different, or combination of types) can be used according to particular needs, desires, or particular implementations of the computer 402 and the described functionality. While memory 407 is illustrated as an internal component of the computer 402, in alternative implementations, memory 407 can be external to the computer 402.

The application 408 can be an algorithmic software engine providing functionality according to particular needs, desires, or particular implementations of the computer 402 and the described functionality. For example, application 408 can serve as one or more components, modules, or applications. Further, although illustrated as a single application 408, the application 408 can be implemented as multiple applications 408 on the computer 402. In addition, although illustrated as internal to the computer 402, in alternative implementations, the application 408 can be external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion and management circuits, including recharging, standby, and power management functionalities. In some implementations, the power-supply 414 can include a power plug to allow the computer 402 to be plugged into a wall socket or a power source to, for example, power the computer 402 or recharge a rechargeable battery.

There can be any number of computers 402 associated with, or external to, a computer system containing computer 402, with each computer 402 communicating over network 430. Further, the terms "client," "user," and other appropriate terminology can be used interchangeably, as appropriate, without departing from the scope of the present disclosure. Moreover, the present disclosure contemplates that many users can use one computer 402 and one user can use multiple computers 402.

Described implementations of the subject matter can include one or more features, alone or in combination.

For example, in a first implementation, a computer-implemented method includes the following. A downhole logging tool is inserted into a well. The downhole logging tool includes a gauge chamber containing gauges, a compressed gas chamber containing compressed gas, a timer powered by a battery, a release sub, and a balloon housing containing a balloon in a deflated state. Data is collected by the gauges of the downhole logging tool during a downward travel of the downhole logging tool. A release point to release compressed gas is determined by the timer based on a travelling speed of the downhole logging tool. The compressed gas is released by the release sub at the release point, inflating the balloon to an inflated state, and creating a buoyant force for the downhole logging tool. Additional data is collected by the gauges of the downhole logging tool during an upward travel of the downhole logging tool.

The foregoing and other described implementations can each, optionally, include one or more of the following features:

A first feature, combinable with any of the following features, where inserting the downhole logging tool into the well includes dropping the downhole logging tool into the well at the surface of a gas or oil well.

A second feature, combinable with any of the previous or following features, where the compressed gas is compressed helium.

A third feature, combinable with any of the previous or following features, where the release sub is powered by the battery.

A fourth feature, combinable with any of the previous or following features, where determining the release point and releasing the compressed gas includes triggering the release point at a preprogrammed depth that is triggered based on the timer and travelling speed.

A fifth feature, combinable with any of the previous or following features, the method further including pre-programming the downhole logging tool with a time at which to release the compressed gas.

A sixth feature, combinable with any of the previous or following features, the method further including pre-programming the downhole logging tool with a depth at which to release the compressed gas.

In a second implementation, a non-transitory, computer-readable medium stores one or more instructions executable by a computer system to perform operations including the following. A downhole logging tool is inserted into a well. The downhole logging tool includes a gauge chamber containing gauges, a compressed gas chamber containing compressed gas, a timer powered by a battery, a release sub, and a balloon housing containing a balloon in a deflated state. Data is collected by the gauges of the downhole logging tool during a downward travel of the downhole logging tool. A release point to release compressed gas is determined by the timer based on a travelling speed of the downhole logging tool. The compressed gas is released by the release sub at the release point, inflating the balloon to an inflated state, and creating a buoyant force for the downhole logging tool. Additional data is collected by the gauges of the downhole logging tool during an upward travel of the downhole logging tool.

The foregoing and other described implementations can each, optionally, include one or more of the following features:

A first feature, combinable with any of the following features, where inserting the downhole logging tool into the well includes dropping the downhole logging tool into the well at the surface of a gas or oil well.

A second feature, combinable with any of the previous or following features, where the compressed gas is compressed helium.

A third feature, combinable with any of the previous or following features, where the release sub is powered by the battery.

A fourth feature, combinable with any of the previous or following features, where determining the release point and releasing the compressed gas includes triggering the release point at a preprogrammed depth that is triggered based on the timer and travelling speed.

A fifth feature, combinable with any of the previous or following features, the operations further including preprogramming the downhole logging tool with a time at which to release the compressed gas.

A sixth feature, combinable with any of the previous or following features, the operations further including preprogramming the downhole logging tool with a depth at which to release the compressed gas.

In a third implementation, a computer-implemented system includes a downhole logging tool configured to be inserted into a well, where the downhole logging tool includes a gauge chamber containing gauges, a compressed gas chamber containing compressed gas, a timer powered by a battery, a release sub-assembly (sub), and a balloon housing containing a balloon in a deflated state. The computer-implemented system also includes one or more processors and a non-transitory computer-readable storage medium coupled to the one or more processors and storing programming instructions for execution by the one or more processors. The programming instructions instruct the one or more processors to perform operations including the following. Data is collected by the gauges of the downhole logging tool during a downward travel of the downhole logging tool. A release point to release compressed gas is determined by the timer based on a travelling speed of the downhole logging tool. The compressed gas is released by the release sub at the release point, inflating the balloon to an inflated state, and creating a buoyant force for the downhole logging tool. Additional data is collected by the gauges of the downhole logging tool during an upward travel of the downhole logging tool.

The foregoing and other described implementations can each, optionally, include one or more of the following features:

A first feature, combinable with any of the following features, where inserting the downhole logging tool into the well includes dropping the downhole logging tool into the well at the surface of a gas or oil well.

A second feature, combinable with any of the previous or following features, where the compressed gas is compressed helium.

A third feature, combinable with any of the previous or following features, where the release sub is powered by the battery.

A fourth feature, combinable with any of the previous or following features, where determining the release point and releasing the compressed gas includes triggering the release point at a preprogrammed depth that is triggered based on the timer and travelling speed.

A fifth feature, combinable with any of the previous or following features, the operations further including preprogramming the downhole logging tool with a time at which to release the compressed gas.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY.

The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A method, comprising:

inserting a downhole logging tool into a well, wherein the downhole logging tool includes a gauge chamber containing gauges, a compressed gas chamber containing compressed gas, a timer powered by a battery, a release sub-assembly, and a balloon housing containing a balloon in a deflated state;

collecting, by the gauges of the downhole logging tool, data during a downward travel of the downhole logging tool;

determining, by the timer and based on a travelling speed of the downhole logging tool, a release point to release compressed gas;

releasing, by the release sub-assembly at the release point and at a rate and a duration controlled by the release sub-assembly, the compressed gas, wherein releasing the compressed gas inflates the balloon to an inflated state, and wherein, with the balloon in the inflated state, the downhole logging tool is configured to float in a gas phase in the well; and collecting, by the gauges of the downhole logging tool, additional data during an upward travel of the downhole logging tool.

2. The method of claim 1, wherein inserting the downhole logging tool into the well includes dropping the downhole logging tool into the well at the surface of the well.

3. The method of claim 1, wherein the compressed gas is compressed helium.

4. The method of claim 1, wherein the release sub-assembly is powered by the battery.

5. The method of claim 1, wherein determining the release point and releasing the compressed gas includes triggering the release point at a preprogrammed depth that is triggered based on the timer and travelling speed.

6. The method of claim 1, further comprising:

pre-programming the downhole logging tool with a time at which to release the compressed gas.

7. The method of claim 1, further comprising:

pre-programming the downhole logging tool with a depth at which to release the compressed gas.

8. A downhole logging tool, comprising:

a gauge chamber containing gauges, wherein the gauges are configured to collect data during a downward travel or an upward travel of the downhole logging tool through a well;

a compressed gas chamber coupled to the gauge chamber, wherein the compressed gas chamber contains compressed gas, and wherein the compressed gas chamber is configured to release the compressed gas at a release point;

a timer coupled to the gauge chamber, wherein the timer is powered by a battery, and wherein the timer is configured to determine, based at least on a travelling speed of the downhole logging tool, the release point to release the compressed gas;

a balloon housing coupled to the compressed gas chamber, wherein the balloon housing contains a balloon in a deflated state; and a release sub-assembly coupled to the compressed gas chamber, wherein the release sub-assembly is configured to release, at the release point, the compressed gas at a rate controlled and adjustable at a surface of the well, and wherein releasing the compressed gas inflates the balloon to an inflated state, and wherein the inflated state of the balloon creates a buoyant force for the downhole logging tool to float in a gas phase of the well.

9. The downhole logging tool of claim 8, wherein the downhole logging tool is inserted into the well by dropping the downhole logging tool into the well at the surface.

10. The downhole logging tool of claim 8, wherein the compressed gas is compressed helium.

11. The downhole logging tool of claim 8, wherein the release sub-assembly is powered by the battery.

12. The downhole logging tool of claim 8, wherein the release point is a preprogrammed depth that is triggered based on the timer and the travelling speed.

13. The downhole logging tool of claim 8, wherein the downhole logging tool is pre-programmed with a time at which to release the compressed gas.

14. A method, comprising:

loading a plurality of gauges into a gauge carrier of a downhole logging tool, each gauge configured to take measurements or readings related to wellbore properties when each gauge travels uphole or downhole through a well;

attaching a balloon in a deflated state to the gauge carrier;

attaching a release sub-assembly to the balloon in the deflated state, the release sub-assembly configured to release compressed gas into the balloon;

attaching a gas chamber to the release sub-assembly, the gas chamber storing the compressed gas to be released into the balloon, the release sub-assembly configured to control a rate and a duration at which the gas chamber releases the compressed gas into the balloon, the gauge carrier, the balloon, the release sub-assembly and the gas chamber forming a downhole logging tool;

dropping the downhole logging tool into a well, wherein the plurality of gauges in the gauge carrier take the measurements or readings related to the wellbore properties when each gauge travels downhole through the well; and after a time has expired since dropping the downhole logging tool into the well, releasing the compressed gas from the gas chamber into the balloon causing the balloon to inflate, wherein the inflated balloon alters a buoyancy of the downhole logging tool causing the downhole logging tool to travel upwards through a gas phase in the well, wherein the plurality of gauges in the gauge carrier take additional measurements or readings related to the wellbore properties when each gauge travels uphole through the well.

15. The method of claim 14, wherein the downhole logging tool travels through oil and the gas phases of the well.

16. The method of claim 14, wherein the compressed gas is compressed helium.

17. The method of claim 14, further comprising attaching a timer powered by a battery to the release sub-assembly, wherein the timer determines that the time has expired.

18. The method of claim 17, wherein the timer determines that the time has expired based on a travelling speed of the downhole logging tool.

19. The method of claim 17, wherein the release sub-assembly is powered by the battery.

20. The method of claim 14, wherein the balloon is housed in a balloon housing.

* * * * *